US007469904B2

(12) United States Patent
Chen

(10) Patent No.: US 7,469,904 B2
(45) Date of Patent: Dec. 30, 2008

(54) FRONT COVER OF TARGET FRAME OF DARTBOARD

(75) Inventor: Huakun Chen, Hefei (CN)

(73) Assignee: Hefei Holding Sports Equipment Co., Ltd., Hefei (CN)

( * ) Notice: Subject to any disclaimer, the term of this patent is extended or adjusted under 35 U.S.C. 154(b) by 38 days.

(21) Appl. No.: 11/660,193

(22) PCT Filed: Oct. 10, 2004

(86) PCT No.: PCT/CN2004/001149

§ 371 (c)(1),
(2), (4) Date: Feb. 12, 2007

(87) PCT Pub. No.: WO2006/024201

PCT Pub. Date: Mar. 9, 2006

(65) Prior Publication Data

US 2008/0084029 A1 Apr. 10, 2008

(30) Foreign Application Priority Data

Aug. 28, 2004 (CN) ..... 2004 1 0041838

(51) Int. Cl.
*F41J 3/00* (2006.01)

(52) U.S. Cl. ..... 273/408

(58) Field of Classification Search ..... 273/403, 273/404, 406, 407, 371–377
See application file for complete search history.

(56) References Cited

U.S. PATENT DOCUMENTS 3,891,214 A * 6/1975 Scullin ..... 273/408
4,982,967 A * 1/1991 Kicks ..... 273/408
5,188,372 A * 2/1993 Tadej ..... 273/408
5,209,491 A * 5/1993 Dodge ..... 273/371
5,884,916 A * 3/1999 Yiu ..... 273/403

FOREIGN PATENT DOCUMENTS

GB 2026879 A * 2/1980
GB 2103497 A * 2/1983

* cited by examiner

*Primary Examiner*—Mark S Graham
(74) *Attorney, Agent, or Firm*—Perkins Coie LLP

(57) ABSTRACT

The present invention relates to a front cover of target frames of dartboards with a tidy appearance and a long service life, which comprises a cylindrical housing frame provided with a flange at the bottom edge used for connection. A metal gauze or spider is integrated with the cylindrical housing frame at the circumference. The toroidal and radial bars of the metal gauze are all provided with inverted V-shaped grooves, which are in the back of the metal gauze and filled with an injection molding filler to form a flat back surface. The present invention adopts the stamped triangular metal gauze, the cylindrical housing frame made of ABS materials, an assembly nail and the flange, and produces the front cover of targets through injection molding. The present invention not only produces a tidy appearance especially applicable to metal darts, but also increases fun of the game.

4 Claims, 2 Drawing Sheets

FRONT COVER OF TARGET FRAME OF DARTBOARD

CROSS-REFERENCE TO RELATED PATENT APPLICATIONS

The present application claims priority to PCT application PCT/CN2004/001149, filed Oct. 10, 2004, which claims priority to Chinese Patent Application No. 200410041838.1, filed Aug. 28, 2004, which are herein incorporated in their entirety.

FIELD OF THE INVENTION

The present invention relates to improvement solutions of front cover structure of target frames of dartboards, which can be used in various electronic dartboards.

BACKGROUND OF THE INVENTION

The electronic dartboard gauzes in the known technology are mostly made of plastics, and formed with molds. These products lack necessary texture, and their appearance is easily damaged and thus uglified during usage by getting hit. Besides, the possibility of dart off is higher, also impairing fun of the game.

SUMMARY OF THE INVENTION

The present invention provides a front cover of target frames of dartboards with a flat appearance and a long service life.

The present invention adopts the following technical solutions to realize the above purpose:

A front cover of target frames of dartboards, comprising a cylindrical housing frame and a gauze or spider; the gauze is composed of toroidal and radial bars, and the cylindrical housing frame is provided with a flange at the bottom edge used for connection; it is characterized in that the gauze is made of metal, which is integrated with the cylindrical housing frame at the circumference through injection molding.

The front cover of target frames of dartboards is characterized in that the toroidal and radial bars of the metal gauze are all provided with V-shaped grooves; the inverted V-shaped grooves in the back of the metal gauze are filled with an injection molding filler to form a flat back surface.

The front cover of target frames of dartboards is characterized in that the inverted V-shaped groove at the circumference of the metal gauze is provided with a flanging at the edge to facilitate fixing the injection molding filler.

The front cover of target frames of dartboards is characterized in that the metal gauze is provided with a casing at the circumference, which extends toward the cylindrical housing frame and is integrated with the cylindrical housing frame through injection molding; the casing is provided with a flanging.

The gauze composed of the metal gauze and the injection molding filler is provided with an assembly nail on the back, which corresponds to a central preplastic hole of a target guide post.

The metal gauze is stamped from electroplated stainless steel or cold rolled sheets.

The technical points of the present invention are that the metal gauze is integrated with the cylindrical housing frame at the circumference through injection molding; in order to secure the integration, the metal gauze can be provided at the circumference with a casing, a flanging, an inverted V-shaped groove or other shapes of toroidal groove, barb, etc., or the combination of the above technical characteristics, so as to seize the cylindrical housing frame, make the metal gauze hard to fall off the cylindrical housing frame, and enlong its service life.

It can be known from the above technical solutions that the present invention adopts the stamped triangular metal gauze, the cylindrical housing frame made of ABS materials, the assembly nail and the flange, and produces the front cover of targets through injection molding; the present invention not only produces a tidy appearance especially applicable to metal darts, but also increases fun of the game, providing a technical support for the transition from safe electronic targets to steel needle electronic targets.

DETAILED DESCRIPTION OF THE EMBODIMENTS

Figure 1:
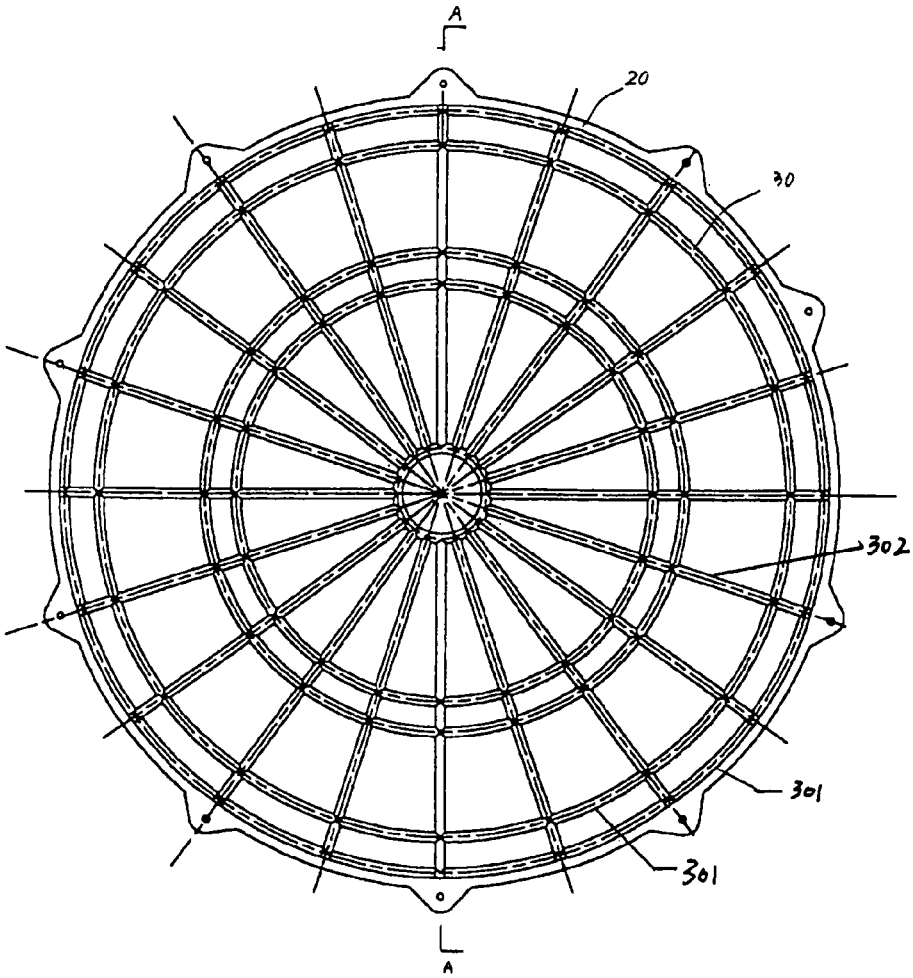
FIG. 1 is a schematic view of the structure of the present invention.
Figure 2:
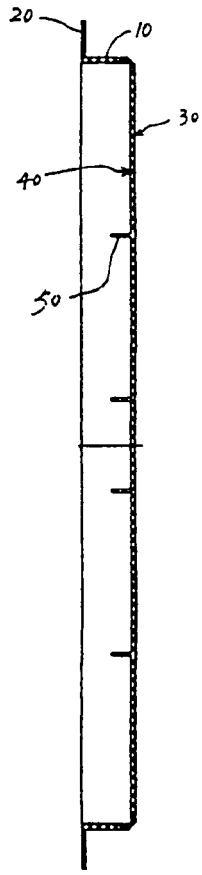
FIG. 2 is a sectional view of A-A in FIG. 1.
Figure 3:
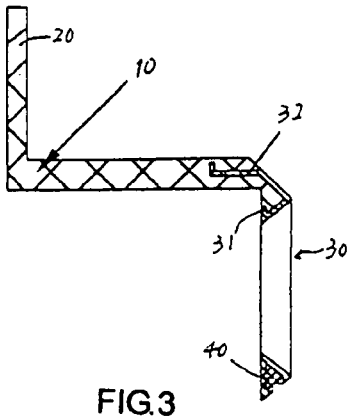
FIG. 3 is a partial enlarged view of FIG. 2.
Figure 4:
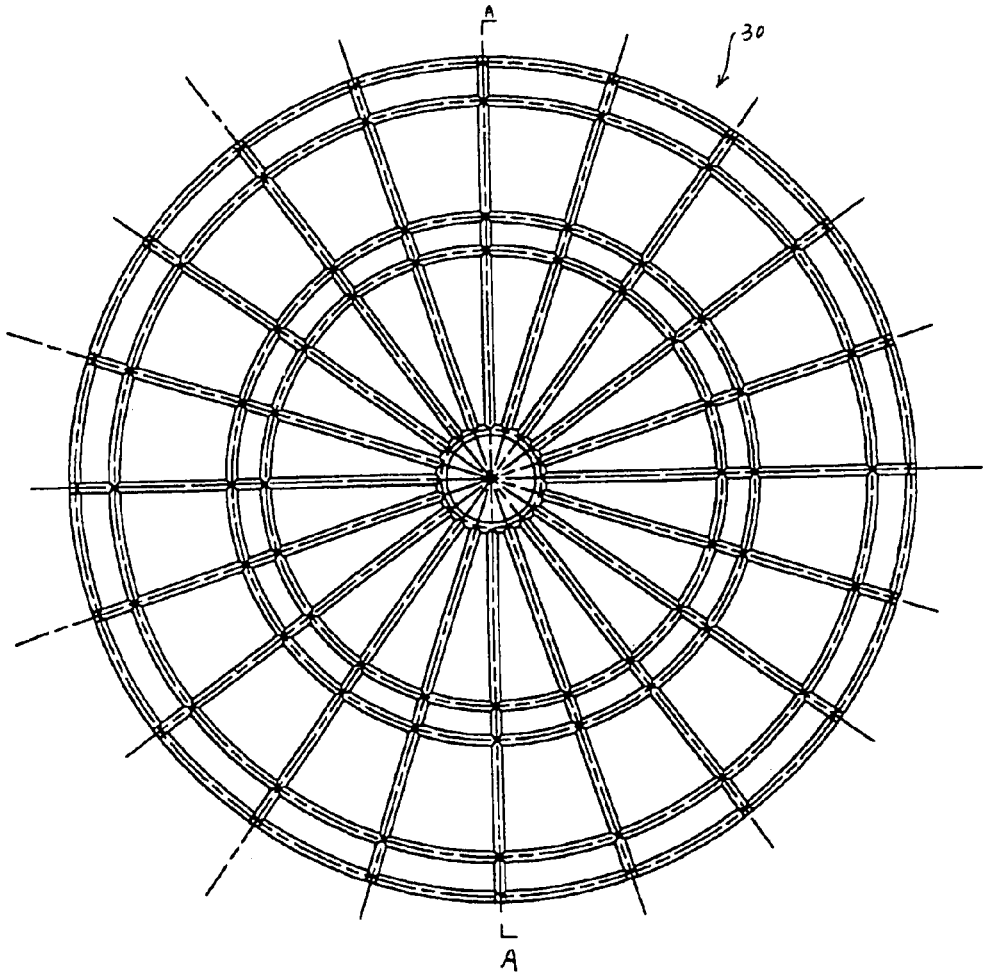
FIG. 4 is a schematic view of the metal gauze structure of the present invention.
Figure 5:
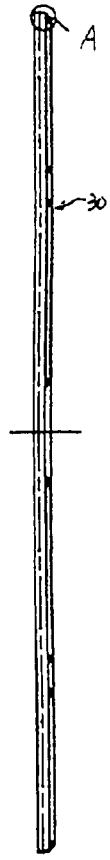
FIG. 5 is a sectional view of A-A in FIG. 4.
Figure 6:
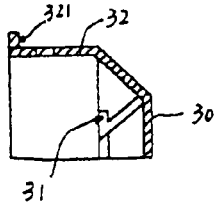
FIG. 6 is an enlarged view of section A in FIG. 5.

As shown in FIGS. 1, 2 and 3, the front cover of target frames of dartboards includes a cylindrical housing frame 10, which is provided with a flange 20 at the bottom edge used for connection; a metal gauze 30 is composed of toroidal bars 301 and radial bars 302 provided with inverted V-shaped grooves with an inverted V-shaped section; a casing 32 at the circumference of the metal gauze 30 is integrated with the cylindrical housing frame 10 through injection molding; the inverted V-shaped grooves in the back of the metal gauze 30 (in the back of the toroidal bars 301 and the radial bars 302) are filled with an injection molding filler 40 to form a flat back surface. The present invention adopts the metal gauze 30, which is stamped from metal sheets with stretch molds, stamping machines, oil hydraulic presses, etc.; the inverted V-shaped groove at the circumference of the metal gauze 30 is provided with a flanging 31 at the edge to facilitate fixing the injection molding filler 40, with the flanging 31 ensuring that the injection molding filler 40 of ABS plastics filled in the inverted V-shaped groove through injection molding is reliably fixed; the casing 32, extending toward the cylindrical housing frame 10 at the circumference of the metal gauze 30, is provided with a flanging 321; the casing 32 is fixed inside the cylindrical housing frame 10 through injection molding, which will be advantageous to the firm connection of the metal gauze 30 with the cylindrical housing frame 10. The gauze composed of the metal gauze 30 and the injection molding filler 40 is provided with an assembly nail 50 on the back, which corresponds to a central preplastic hole of a target guide post; the assembly nail 50 is of an injection molding piece. ABS plastics are used as raw materials for the injection molding pieces in the present invention.

What is claimed is:

1. A front cover of target frames of a dartboard, comprising a cylindrical housing frame and a spider, wherein:

the spider is composed of toroidal and radial bars;

the cylindrical housing frame is provided with a flange at the bottom edge used for connection;

the spider is made of metal and integrated with the cylindrical housing frame at a circumference through injection molding;

the toroidal and radial bars of the spider are provided with inverted V-shaped grooves, which are in the back surface of the spider and filled with an injection molding filler to form a flat back surface; and the inverted V-shaped groove at the circumference of the spider is provided with a flanging at the edge to facilitate fixing an injection molding filler.

2. The front cover of claim 1, wherein a casing is provided with flanging.

3. The front cover of claim 1, wherein the metal spider and the injection molding filler are provided on the back with an assembly nail corresponding to a central preplastic hole of a target guide post.

4. The front cover of claim 1, wherein the metal spider is stamped from electroplated stainless steel or cold rolled sheets.

* * * * *